US006575185B2

(12) United States Patent
Zheng

(10) Patent No.: US 6,575,185 B2
(45) **Date of Patent: *Jun. 10, 2003**

(54) COLLAPSIBLE STRUCTURES

(75) Inventor: Yu Zheng, Covina, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/150,358

(22) Filed: May 16, 2002

(65) Prior Publication Data

US 2002/0124878 A1 Sep. 12, 2002

Related U.S. Application Data

(63) Continuation of application No. 09/847,248, filed on May 2, 2001, now Pat. No. 6,390,111, which is a continuation of application No. 09/633,947, filed on Aug. 8, 2000, now Pat. No. 6,269,826, which is a division of application No. 09/162,086, filed on Sep. 29, 1998, now abandoned, which is a division of application No. 08/859,876, filed on May 21, 1997, now Pat. No. 5,816,279, which is a division of application No. 08/627,875, filed on Apr. 3, 1996, now Pat. No. 5,664,596, which is a continuation of application No. 08/281,369, filed on Jul. 27, 1994, now Pat. No. 5,560,385, which is a continuation-in-part of application No. 08/024,690, filed on Mar. 1, 1993, now Pat. No. 5,467,794, which is a continuation-in-part of application No. 07/764,784, filed on Sep. 24, 1991, now Pat. No. 5,301,705.

(51) Int. Cl.[7] ..... E04H 15/40

(52) U.S. Cl. ..... 135/126; 135/128; 135/144; 135/117; 446/478

(58) Field of Search ..... 135/125, 126, 135/128, 130, 137, 143, 144, 115, 117, 97; 446/476, 478; 220/9.2, 9.3

(56) References Cited

U.S. PATENT DOCUMENTS

| | | | |
|---|---|---|---|
| 2,057,942 | A | 10/1936 | Fay |
| 2,879,553 | A | 3/1959 | Keating |
| 3,502,091 | A | 3/1970 | Corbin |
| 3,675,667 | A | 7/1972 | Miller |
| 3,733,758 | A | 5/1973 | Maier et al. |
| 3,807,421 | A | 4/1974 | Geiger et al. |
| 3,880,459 | A | 4/1975 | Kelley |
| 3,960,161 | A | 6/1976 | Norman |
| 3,987,580 | A | 10/1976 | Ausnit |

(List continued on next page.)

FOREIGN PATENT DOCUMENTS

| | | |
|---|---|---|
| DE | 2015649 | 2/1971 |
| DE | 301318 | 11/1981 |
| DE | 4114916 | 11/1991 |
| FR | 1380738 | 10/1964 |
| FR | 2635136 | 2/1990 |
| GB | 1367 | of 1871 |

*Primary Examiner*—Lanna Mai
*Assistant Examiner*—Winnie Yip
(74) *Attorney, Agent, or Firm*—Raymond Sun

(57) ABSTRACT

A collapsible play structure comprises one or more play modules connected together, each play module comprising at least three foldable frame members, each having a folded and an unfolded orientation. A fabric material substantially covers each frame member to form a side panel for each frame member when the frame member is in the unfolded orientation. Each side panel further comprises at least three sides. The left side of each side panel is connected and hinged to the right side of an adjacent side panel, and the right side of each side panel is connected and hinged to the left side of another adjacent side panel. The bottom side of each side panel is adapted to rest on a supporting surface to support the play module.

4 Claims, 10 Drawing Sheets

U.S. PATENT DOCUMENTS 3,990,463 A 11/1976 Norman
4,073,105 A 2/1978 Daugherty
4,133,149 A 1/1979 Angress
4,165,757 A 8/1979 Marks
4,170,082 A 10/1979 Freedman
4,212,130 A 7/1980 Walker
4,265,261 A 5/1981 Barker
4,632,138 A * 12/1986 Irwin ..... 135/143
4,635,411 A 1/1987 Kurzen
4,716,918 A 1/1988 Hayashida et al.
4,731,716 A * 3/1988 Chang ..... 362/352
4,825,892 A 5/1989 McLeese
4,876,829 A 10/1989 Mattick
5,038,812 A * 8/1991 Norman ..... 135/126
5,054,507 A 10/1991 Sparks
5,134,815 A 8/1992 Pickett
5,137,044 A 8/1992 Brady
5,222,513 A 6/1993 Hilliard
5,301,705 A 4/1994 Zheng
5,394,897 A 3/1995 Ritchey et al.
5,467,794 A 11/1995 Zheng

* cited by examiner

COLLAPSIBLE STRUCTURES

RELATED CASES

This is a continuation of co-pending Ser. No. 09/847,248, filed May 2, 2001, now U.S. Pat. No. 6,390,111, which is a continuation of Ser. No. 09/633,947, filed Aug. 8, 2000, now U.S. Pat. No. 6,269,826, which is a division of Ser. No. 09/162,086, entitled "Collapsible Play Structures", filed Sep. 29, 1998, now abandoned, which is a division of Ser. No. 08/859,876, entitled "Collapsible Play Structures", filed May 21, 1997, now U.S. Pat. No. 5,816,279, which is a division of Ser. No. 08/627,875, entitled "Collapsible Play Structures", filed Apr. 3, 1996, now U.S. Pat. No. 5,664,596, which is a continuation of Ser. No. 08/281,369, entitled "Collapsible Play Structures", filed Jul. 27, 1994, now U.S. Pat. No. 5,560,385, which is a continuation-in-part of Ser. No. 08/024,690, entitled "Collapsible Shade Structure", filed Mar. 1, 1993, now U.S. Pat. No. 5,467,794, which is in turn a continuation-in-part of Ser. No. 07/764,784, entitled "Collapsible Shade Structure", filed Sep. 24, 1991, now U.S. Pat. No. 5,301,705, the entire disclosures of which are incorporated by this reference as though set forth fully herein.

BACKGROUND OF THE INVENTION

1. Field of the Invention

The present invention relates to collapsible structures, and in particular, to collapsible play structures which may be provided in a variety of shapes and sizes. The collapsible play structures may be twisted and folded to reduce the overall size of the play structures to facilitate convenient storage and use.

2. Description of the Prior Art

Two important considerations for all toys or play things targeted for children are convenience and variety. Relating to convenience, a toy must be easily transportable so that the child can move it around the home, or even to other places outside of the home. A toy must also be easily stored since a child is likely to have many other toys that compete for precious storage space in the home. As for variety, a toy must offer enough variety in play so that the child will be able to enjoy it for a long period of time without getting bored.

Larger toys often pose a greater problem with regards to convenience. The larger toys tend to be bulky, which makes it difficult to move them around the home, and sometimes makes it prohibitive to move them outside the house to other locations. Bulky toys also take up much storage space.

In the past, attempts have been made to provide play structures for the entertainment of children. Such play structures have been provided in many different shapes and sizes. For example, some have been shaped as playhouses to allow children to climb into and out of the structure. However, in order to provide a structure that can temporarily house a child, such a structure must be quite large and would be difficult to transport and store.

In response to this problem, attempts have been made to provide play structures that are assembled from generic rigid panels that may be disassembled after use. The generic panels are easily stored into a small container, which makes it convenient to transport and to store. These panels may also be assembled into structures having different shapes and sizes, thereby offering the child with variety. For example, U.S. Pat. No. 4,073,105 to Daugherty provides a fabrication device comprised of differently-shaped rigid panels 10 connected by superimposing the curled locking means 16 of adjacent panels 10. Similarly, U.S. Pat. No. 3,987,580 to Ausnit provides a connective toy comprised of rigid bodies connected by interlocking ribs and grooves. Unfortunately, these play structures suffer from the drawback that it is very time-consuming to disassemble the structure after use for storage, and to re-assemble the structure before use. Since children tend to lack patience, such play structures will normally remain in their assembled state most of the time, which still results in the same problems discussed above.

Thus, there remains a need for a play structure which is convenient to use, to transport, and to store, and which offers play variety to the child.

SUMMARY OF THE DISCLOSURE

In order to accomplish the objects of the present invention, the collapsible play structure according to the present invention comprises a play module comprising at least three foldable frame members, each having a folded and an unfolded orientation. A fabric material substantially covers each frame member to form a side panel for each frame member when the frame member is in the unfolded orientation, with the fabric assuming the unfolded orientation of its associated frame member. Each side panel further comprises at least a left side, a bottom side and a right side. The left side of each side panel is connected and hinged to the right side of an adjacent side panel, and the right side of each side panel is connected and hinged to the left side of another adjacent side panel. The bottom side of each side panel is adapted to rest on a supporting surface to support the play module.

In one embodiment of the present invention, the play module comprises four side panels and four corresponding frame members, each having four sides, including a top side. A fabric is connected to the top sides of the four side panels and extends therebetween, and an opening may be provided in this fabric. Openings may also be provided in one or more of the side panels to allow a child to crawl therethrough.

Each side panel comprises a frame retaining sleeve for retaining one of the frame members. The frame retaining sleeves of adjacent side panels are stitched together to form a hinged connection. Alternatively, the frame retaining sleeves of adjacent side panels may converge to form a singular retaining sleeve which retains the adjacent sides of the adjacent frame members of the corresponding adjacent side panels. The stitchings which connect the frame retaining sleeves act as hinges for the corresponding side panels.

When the play module is to be folded and stored, the side panels and their corresponding frame members may be folded on top of each other about the hinges to have the side panels and frame members overlaying each other. The overlying side panels and frame members are then collapsed by twisting and folding to form a plurality of concentric frame members and side panels to substantially reduce the size of the play module in the folded orientation.

A plurality of the play modules may be connected to create play structures of different shapes and sizes. The play modules may be provided as separate play modules and connected by velcro, hooks, fasteners, or other attachment mechanisms which allow for convenient attachment and detachment. These separate play structures may be provided in identical or different shapes and sizes. Alternatively, a play structure may be provided that has a plurality of play modules integrally connected to form one unitary play structure which may be folded and collapsed according to the same principles as the separate play modules.

The collapsible play structures according to the present invention are convenient for use since they are easily and quickly folded and collapsed into a smaller size for transportation and storage. A plurality of these play modules may be easily transported and stored, and provide a child with much play variety since a large number of play structures having different shapes and sizes can be created therefrom.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
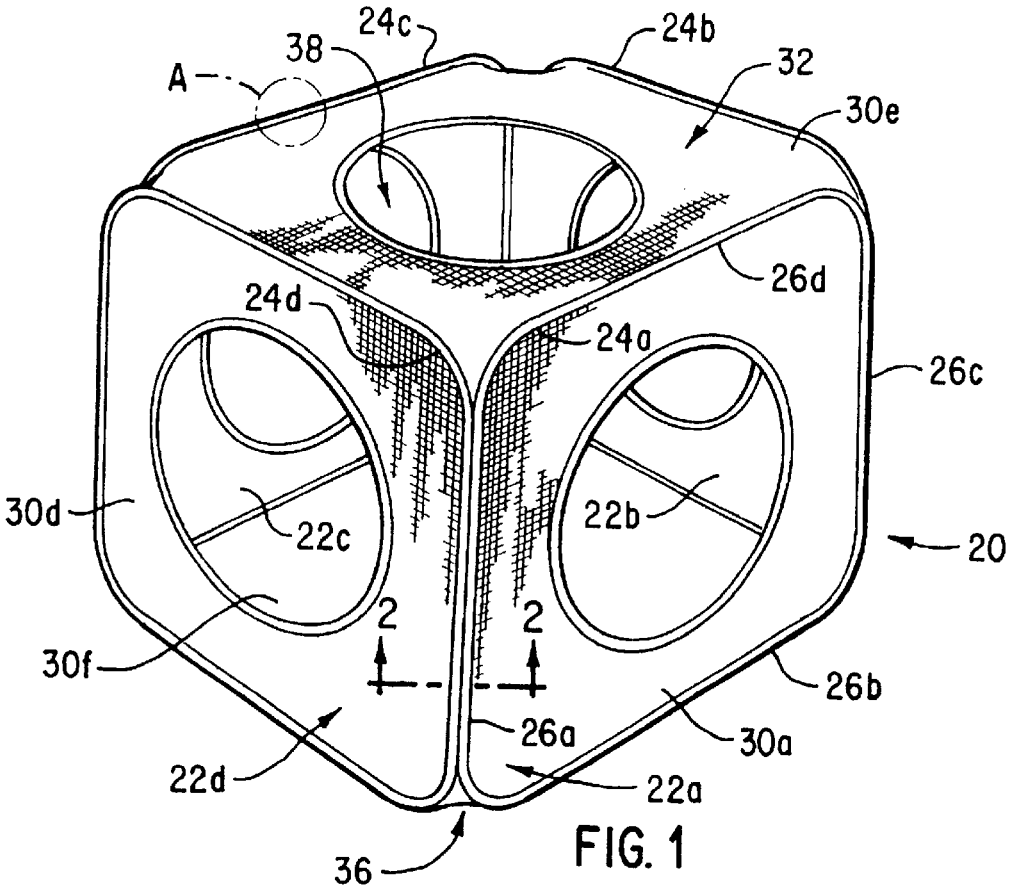
FIG. 1 is a perspective view of a collapsible play structure according to a first preferred embodiment of the present invention having one module.
Figure 1A:
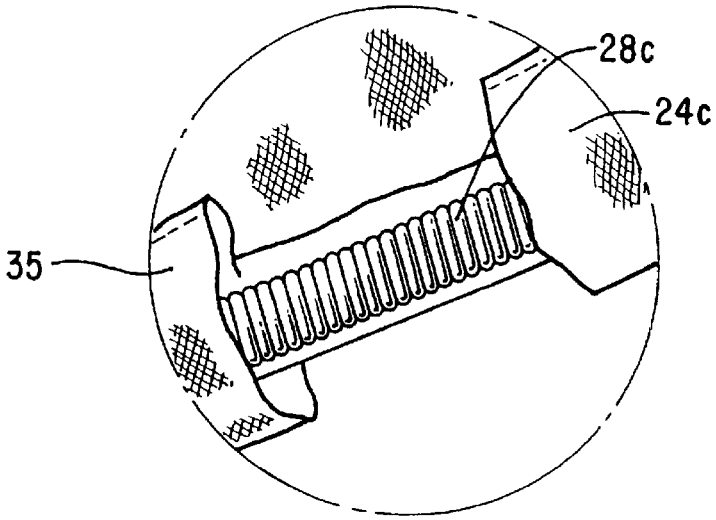
FIG. 1A is a partial cut-away view of the section A of the play structure of FIG. 1 illustrating a frame member retained within a sleeve.

As shown in FIGS. 1 and 1A, the basic component for a collapsible play structure according to the present invention comprises a module 20. As explained in greater detail hereinbelow, the collapsible play structures according to the present invention are each comprised of one or more of these modules 20 assembled to create a resulting play structure having the desired shape and size.

Referring to FIG. 1, according to a first preferred embodiment of the present invention, each module 20 comprises four side panels 22*a*, 22*b*, 22*c* and 22*d* connected to each other to encircle an enclosed space. Each side panel 22*a*, 22*b*, 22*c* and 22*d* has four sides, a left side 26*a*, a bottom side 26*b*, a right side 26*c* and a top side 26*d*. Each side panel 22*a*, 22*b*, 22*c* and 22*d* has a continuous frame retaining sleeve 24*a*, 24*b*, 24*c* or 24*d* provided along and traversing the four edges of its four sides 26*a*, 26*b*, 26*c* and 26*d*. A continuous frame member 28*a*, 28*b*, 28*c* or 28*d* is retained or held within each frame retaining sleeve 24*a*, 24*b*, 24*c* or 24*d*, respectively, to support each side panel 22*a*, 22*b*, 22*c* and 22*d*. Only the frame member 28*c* is shown in FIG. 1A; the other frame members 28*a*, 28*b* and 28*d* are not shown but are the same as frame member 28*c*.

The continuous frame members 28*a*, 28*b*, 28*c* and 28*d* may be provided as one continuous loop, or may comprise a strip of material connected at both ends to form a continuous loop. The continuous frame members 28*a*, 28*b*, 28*c* and 28*d* are preferably formed of flexible coilable steel, although other materials such as plastics may also be used. The frame members should be made of a material which is relatively strong and yet is flexible to a sufficient degree to allow it to be coiled. Thus, each frame member 28*a*, 28*b*, 28*c* and 28*d* is capable of assuming two positions or orientations, an open or expanded position such as shown in FIG. 1, or a folded position in which the frame member is collapsed into a size which is much smaller than its open position (see FIG. 8(E)).

Fabric or sheet material 30*a*, 30*b*, 30*c* and 30*d* extends across each side panel 22*a*, 22*b*, 22*c* and 22*d*, respectively, and is held taut by the respective frame members 28*a*, 28*b*, 28*c* and 28*d* when in its open position. The term fabric is to be given its broadest meaning and should be made from strong, lightweight materials and may include woven fabrics, sheet fabrics or even films. The fabric should be water-resistant and durable to withstand the wear and tear associated with rough treatment by children. The frame members 28*a*, 28*b*, 28*c* and 28*d* may be merely retained within the respective frame retaining sleeves 24*a*, 24*b*, 24*c* and 24*c* without being connected thereto. Alternatively, the frame retaining sleeves 24*a*, 24*b*, 24*c* and 24*d* may be mechanically fastened, stitched, fused, or glued to the frame members 28*a*, 28*b*, 28*c* and 28*d*, respectively, to retain them in position.

Figure 2A:
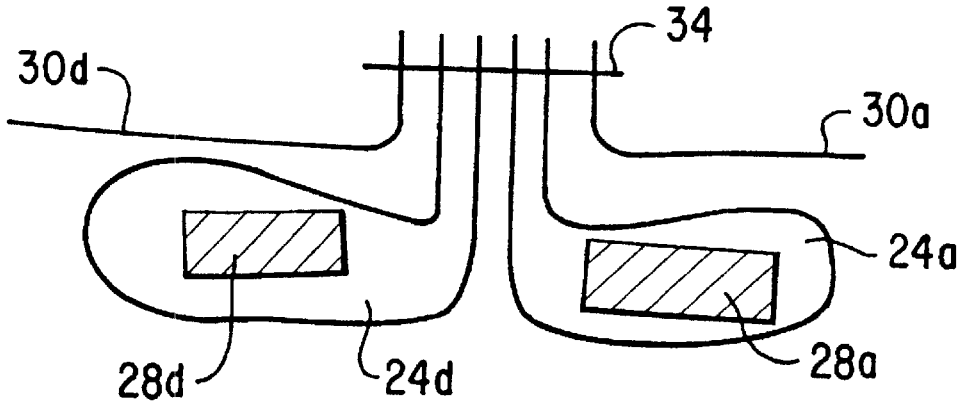
FIG. 2A is a cross-sectional view of a first preferred connection between two adjacent panels of the module of FIG. 1 taken along line 2—2 thereof.

FIG. 2A illustrates one preferred connection for connecting adjacent edges of two side panels 22*a* and 22*d*. The fabric pieces 30*a* and 30*d* are stitched at their edges by a stitching 34 to the respective sleeves 24*a* and 24*d*. Each sleeve 24*a* and 24*d* may be formed by folding a piece of fabric. The stitching 34 also acts as a hinge for the side panels 22*a* and 22*d* to be folded upon each other, as explained below. The connections for the three other pairs of adjacent edges may be identical. Thus, the connections on the left side 26*a* and the right side 26*c* of each side panel 22*a*, 22*b*, 22*c* and 22*d* act as hinge connections for connecting an adjacent side panel.

At the top side 26*d* and the bottom side 26*b* of each side panel 22*a*, 22*b*, 22*c* and 22*d*, where there is no hinge connection to an adjacent side panel, the frame retaining sleeve 24*a*, 24*b*, 24*c* or 24*b* may be formed by merely folding over the corresponding fabric piece and applying a stitching 35 (see FIG. 1A). The fabric piece for the corresponding side panel may then be stitched to the sleeve.

Figure 2B:
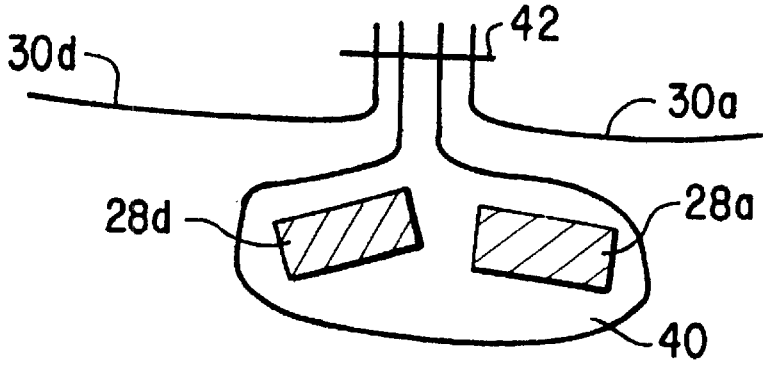
FIG. 2B is a cross-sectional view of a second preferred connection between two adjacent panels of the module of FIG. 1 taken along line 2—2 thereof.

FIG. 2B illustrates a second preferred connection for connecting adjacent edges of two side panels 22*a* and 22*d*. As in the connection of FIG. 2A, the fabric pieces 30*a* and 30*d* are folded over at their edges at bottom side 26*b* and top side 26*d* to define the respective sleeves 24*a* and 24*d*. However, the frame retaining sleeves 24*a* and 24*d* converge at, or are connected to, one sleeve portion which interconnects side panels 22*a* and 22*d* to form a singular frame retaining sleeve 40 which retains the frame members 28*a* and 28*d*. Sleeve 40 may be formed by providing a tubular fabric, or by folding a piece of fabric, and applying a stitching 42 to its edges to connect the sleeve 40 to the fabric pieces 30*a* and 30*d*. Stitching 42 acts as a hinge for the side panels 22*a* and 22*d*. The connections for the three other pairs of adjacent edges may be identical.

An upper panel 32 comprised of fabric 30*e* may also be connected to the upper edge 26*d* of each side panel 22*a*, 22*b*, 22*c* and 22*d*. Likewise, a lower panel 36 comprised of fabric 30*f* may also be connected to the bottom edge 26*b* of each side panel 22*a*, 22*b*, 22*c* and 22*d*. The upper panel 32 and the lower panel 36 are preferably made of the same type of fabric as the side panels 22*a*, 22*b*, 22*c* and 22*d*. Each module 20 preferably comprises at least the four side panels 22*a*, 22*b*, 22*c* and 22*d*, with the upper and lower panels 32 and 36 being optional.

Openings 38 may be provided in some or all of the panels 22*a*, 22*b*, 22*c*, 22*d*, 32 and 36. These openings 38 may be of any shape (e.g., triangular, circular, rectangular, square, diamond, etc.) and size and are designed to allow children to crawl through them to enter or to exit the module 20.

While the module 20 of FIG. 1 is shown and described as having four side panels, each having four sides, it will be appreciated that a module may be made of any number of side panels, each having any number of sides, without departing from the spirit and scope of the present invention. For example, each module may have three or more side panels, and each side panel may have three or more sides. Thus, the module of the present invention may take a variety of external shapes. However, each side panel of the module, regardless of its shape, is supported by at least one continuous frame member.

Figure 8A:
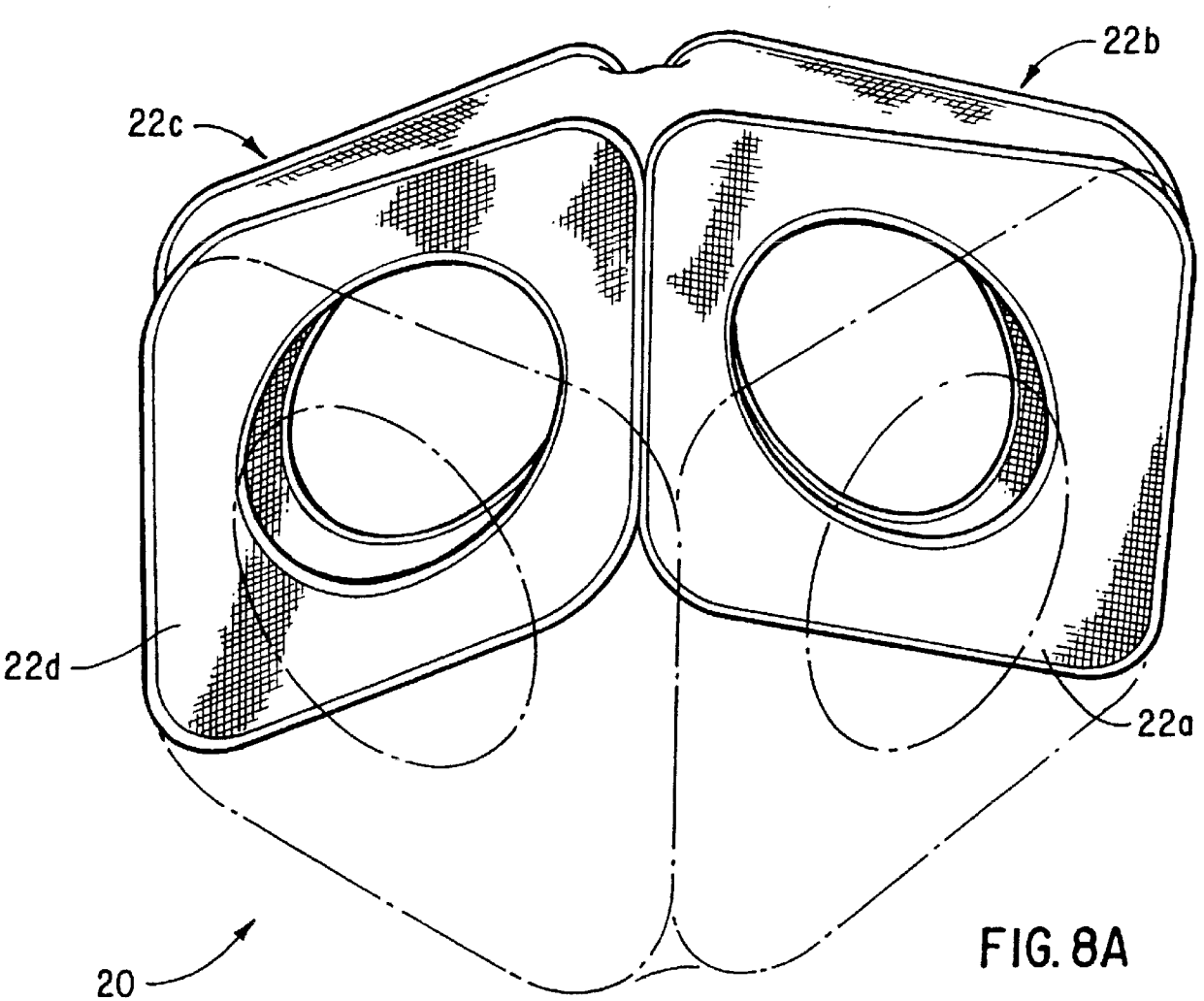
FIGS. 8(A) through 8(E) illustrate how the collapsible play structure of FIG. 1 may be twisted and folded for compact storage.
Figure 8B:
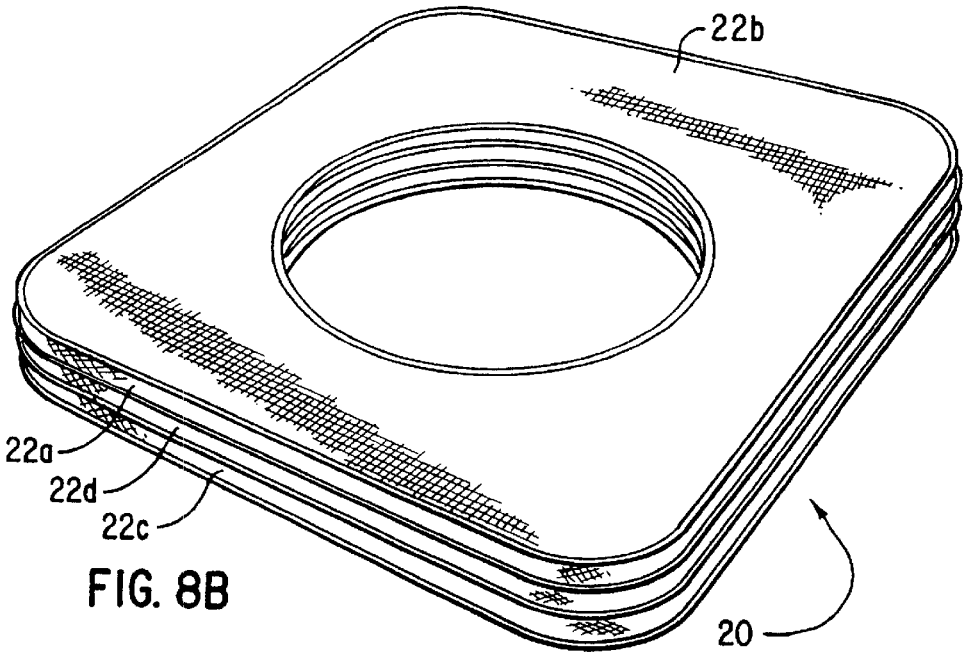
Figure 8C:
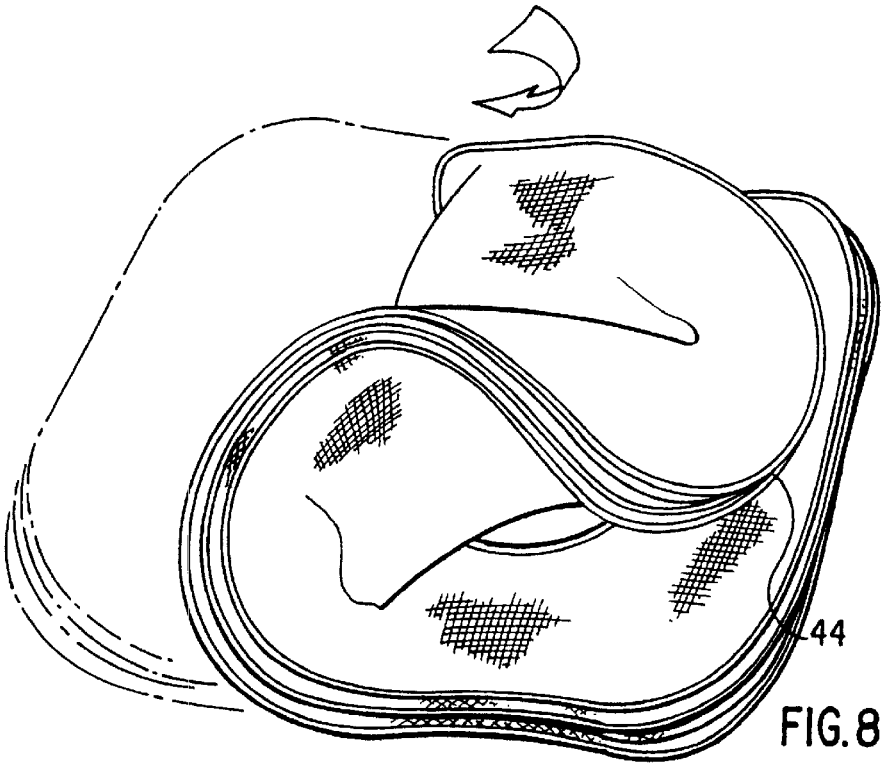
Figure 8D:
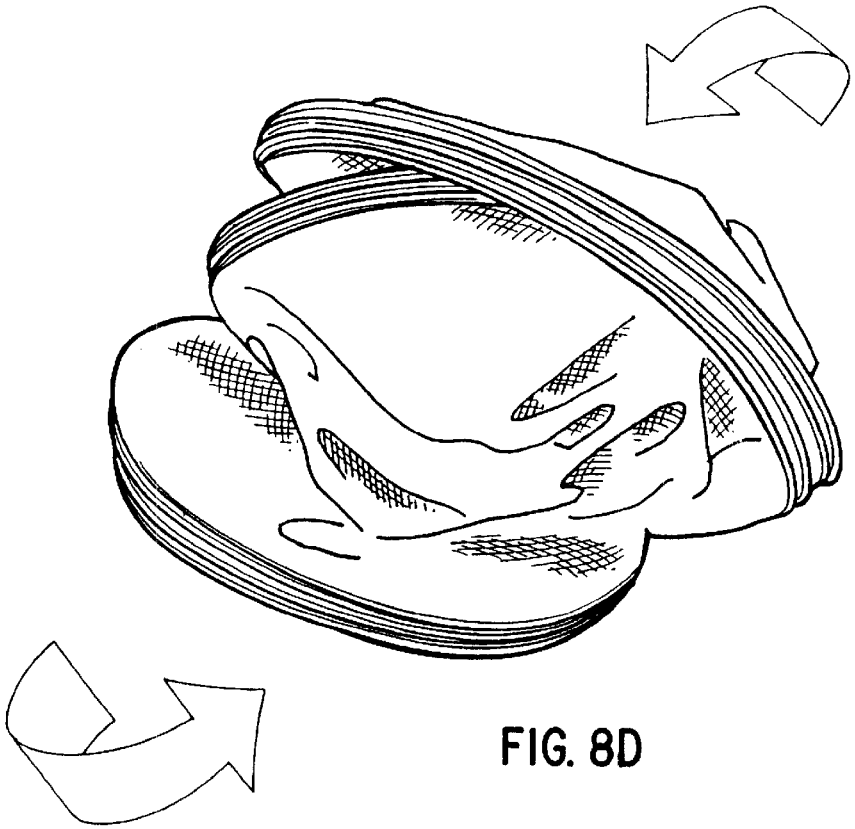
Figure 8E:
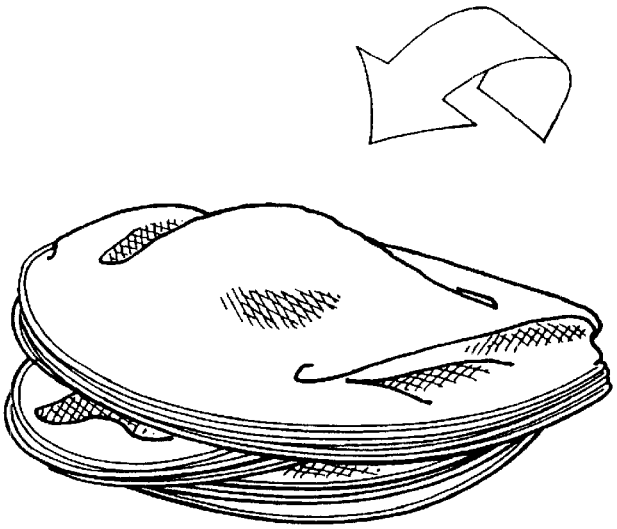

FIGS. 8(A) through 8(E) describe the various steps for folding and collapsing the module 20 of FIG. 1 for storage. In FIG. 8(A), the first step consists of pushing in side panels 22*a* and 22*d* such that side panel 22*d* collapses upon side panel 22*c* and side panel 22*a* collapses upon side panel 22*b*. Then, in the second step shown in FIG. 8(B), the two side panels 22*a* and 22*b* are folded so as to be collapsed upon the two side panels 22*c* and 22*d*. The structure is then twisted and folded to collapse the frame members and side panels into a smaller shape. In the third step shown in FIG. 8(C), the opposite border 44 of the structure is folded in upon the previous fold to further collapse the frame members with the side panels. As shown in FIG. 8(D), the fourth step is to continue the collapsing so that the initial size of the structure is reduced. FIG. 8(E) shows the fifth step with the frame members and side panels collapsed on each other to provide for a small essentially compact configuration having a plurality of concentric frame members and layers of the side panels so that the collapsed structure has a size which is a fraction of the size of the initial structure.

Figure 3:
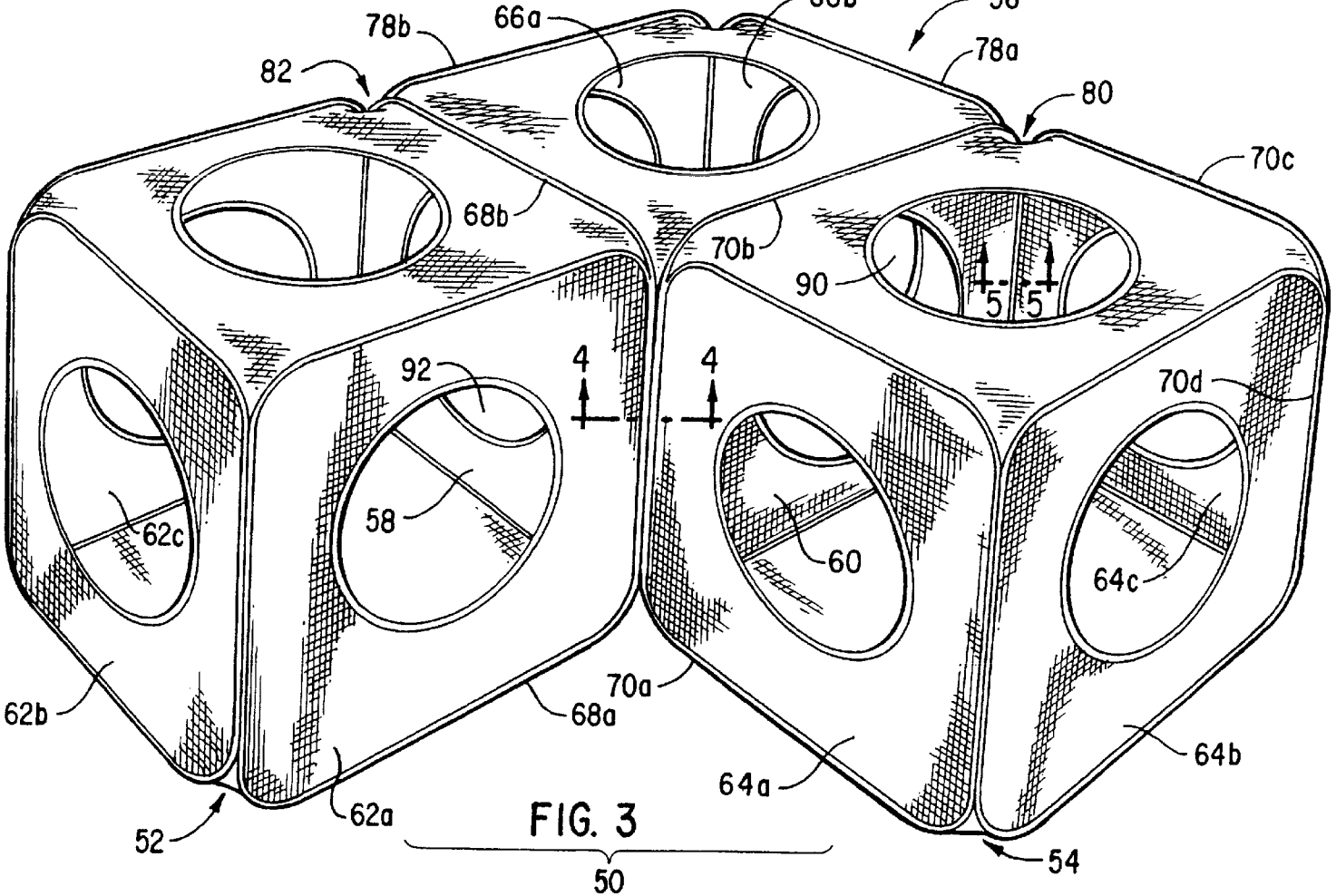
FIG. 3 is a perspective view of a collapsible play structure according to a second preferred embodiment of the present invention comprising three modules.

A second preferred embodiment of the present invention is shown in FIG. 3. A play structure 50 comprises three modules 52, 54 and 56 provided in an attached manner. Each module 52, 54 and 56 is essentially of the same construction as module 20, except that modules 52 and 56 share a common side panel 58, and modules 54 and 56 share a common side panel 60. The connections between adjacent side panels (i.e., the two side panel connections) may be the same as any of those illustrated in FIGS. 2A and 2B above.

Figure 4B:
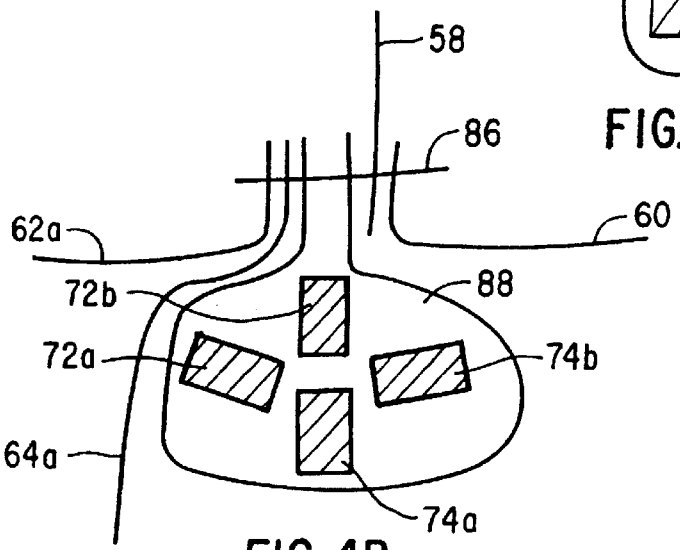
FIG. 4B is a cross-sectional view of a second preferred connection between the four adjacent panels of the modules of FIG. 3 taken along line 4—4 thereof.
Figure 4A:
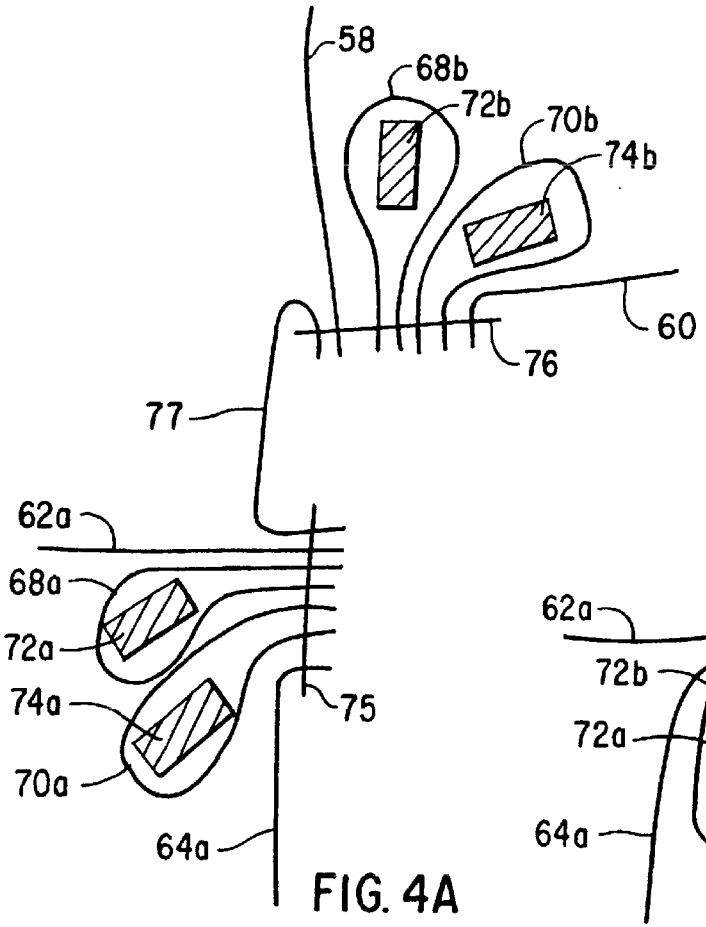
FIG. 4A is a cross-sectional view of a first preferred connection between the four adjacent panels of the modules of FIG. 3 taken along line 4—4 thereof.

FIG. 4A illustrates a preferred four side panel connection along line 4—4 of FIG. 3, in which the four frame retaining sleeves 68*a*, 68*b*, 70*a* and 70*b* each retain a frame member 72*a*, 72*b*, 74*a* and 74*b*, respectively. Sleeves 68*a* and 70*a*, and side panels 62*a* and 64*a*, are connected by a stitching 75 and sleeves 68*b* and 70*b*, and side panels 58 and 60, are connected by a stitching 76. Each of the stitchings 75 and 76 also connect an interconnecting hinge fabric 77 which holds the two pairs of sleeves 68*a*, 70*a* and 68*b*, 70*b* together, and acts to hinge these two pairs of sleeves.

Alternatively, FIG. 4B illustrates a second preferred connection in which the four frame retaining sleeves 68*a*, 68*b*, 70*a* and 70*b*, each formed by a separate stitching, converge to form, or are connected to, one singular frame retaining sleeve 88 which retains the frame members 72*a*, 72*b*, 74*a* and 74*b*. The singular frame retaining sleeve 88 is created by folding a fabric material, or providing a tubular fabric, and applying a stitching 86 to connect the sleeve 88 to the side panels 58, 60, 62*a* and 64*a*. Stitching 86 acts as a hinge for the side panels 58, 60, 62*a* and 64*a*.

Figure 4C:
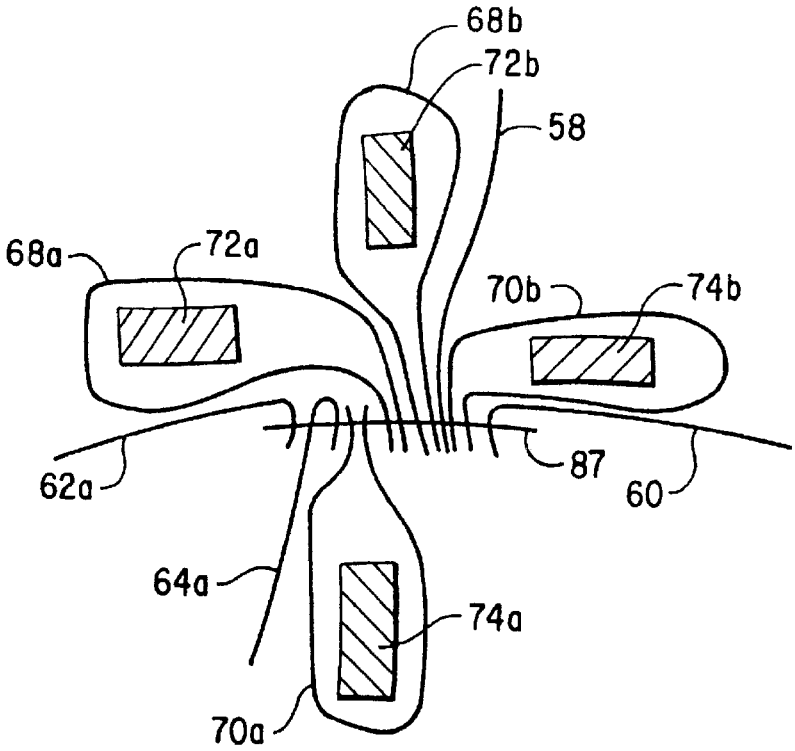
FIG. 4C is a cross-sectional view of a third preferred connection between the four adjacent panels of the modules of FIG. 3 taken along line 4—4 thereof.
Figure 4D:
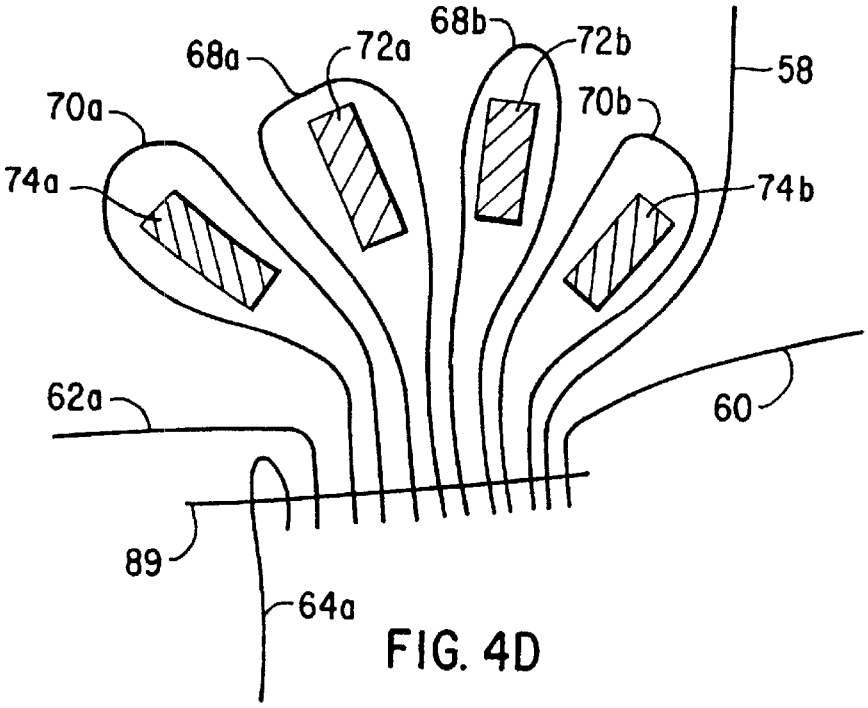
FIG. 4D is a cross-sectional view of a fourth preferred connection between the four adjacent panels of the modules of FIG. 3 taken along line 4—4 thereof.

FIGS. 4C and 4D illustrate third and fourth preferred connections in which the four frame retaining sleeves 68*a*, 68*b*, 70*a* and 70*b* each retain a frame member 72*a*, 72*b*, 74*a* and 74*b*, respectively, and are stitched together with the fabric pieces of the side panels 62*a*, 64*a*, 58 and 60 by stitching 87 (FIG. 4C) and stitching 89 (FIG. 4D). The stitchings 87 and 89 also act to hinge the side panels 58, 60, 62*a* and 64*a*.

Figure 5B:
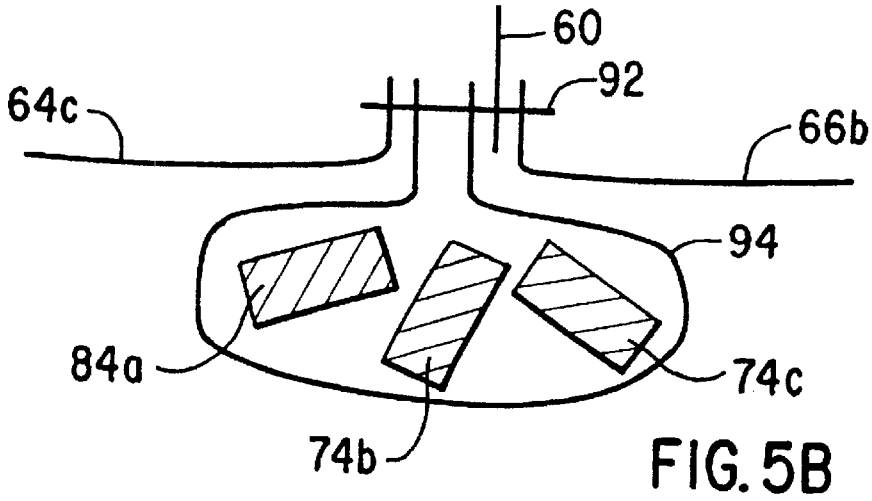
FIG. 5B is a cross-sectional view of a second preferred connection between the three adjacent panels of the modules of FIG. 3 taken along line 5—5 thereof.
Figure 5A:
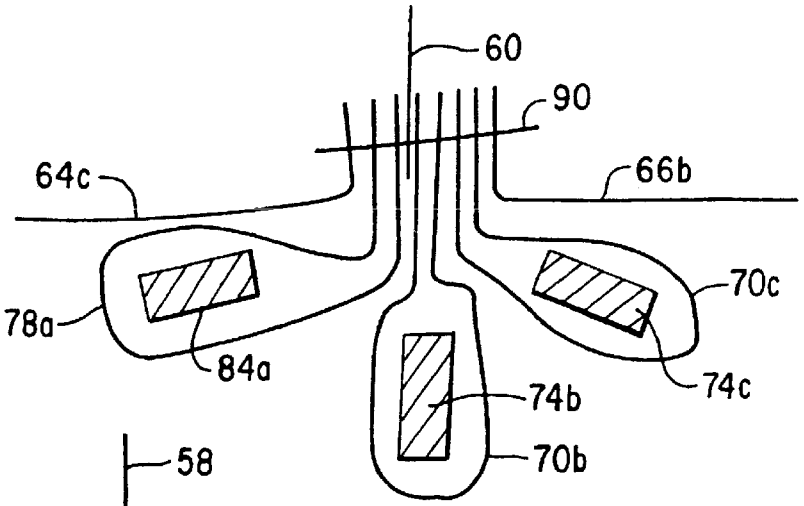
FIG. 5A is a cross-sectional view of a first preferred connection between the three adjacent panels of the modules of FIG. 3 taken along line 5—5 thereof.

FIG. 5A illustrates a preferred connection for the three side panel connection 80 along line 5—5 of FIG. 3, in which the three frame retaining sleeves 70*b*, 70*c* and 78*a* each retain a frame member 74*b*, 74*c* and 84*a*, respectively, and are held together by stitching 90. The fabric pieces of side panels 60, 64*c* and 66*b* are also stitched to the sleeves 70*b*, 70*c* and 78*a* by the stitching 90. Alternatively, FIG. 5B illustrates a second preferred connection in which the three frame retaining sleeves 70*b*, 70*c* and 78*a*, each formed by a separate stitching, converge to form, or are connected to, one singular frame retaining sleeve 94 which retains the frame members 74*b*, 74*c* and 84*a*. The singular frame retaining sleeve 94 is created by folding a fabric material and applying a stitching 92 to hold the sleeve 94 together with the side panels 60, 64*c* and 66*b*. The stitchings 90 and 92 act as hinges for the side panels 60, 64*c* and 66*b*. The three side panel connection 82 is identical to the three side panel connection 80 and is not further discussed herein.

To fold and collapse the play structure 50, the side panels 62*a* and 62*b* of module 52 are pushed onto side panels 58 and 62*c*, respectively, the side panels 64*a* and 64*b* of module 54 are pushed onto side panels 60 and 64*c*, respectively, and the side panels 66*a* and 66*b* of module 56 are pushed onto side panels 58 and 60, respectively. Thereafter, combined side panels 62*b* and 62*c* are folded over to be collapsed upon the combined side panels 62*a* and 58, and combined side panels 64*b* and 64*c* are folded over to be collapsed upon the combined side panels 64*a* and 60. The combined side panels 66*b*, 60, 64*a*, 64*b* and 64*c* are then folded over and collapsed upon the combined side panels 66*a*, 58, 62*a*, 62*b* and 62*c*, thereby creating a stack of ten side panels. The combined stack of ten side panels may then be twisted and folded in the manner described above in connection with FIGS. 8(C)–8(E).

Alternatively, the three modules 52, 54 and 56 of play structure 50 may be provided as three separate modules, each having four side panels. Each such module could be identical to module 20 of FIG. 1. The three separate modules may be connected by conventional attachment methods such as velcro, hooks, loops, fasteners or others, to create the play structure 50, or another structure with a different shape. For example, a child may choose to create a play structure having three linear modules 52, 54 and 56. The attachment method allows for convenient attachment and detachment. Each module may be folded and collapsed in the manner described in FIGS. 8(A)–8(E) for convenient storage.

Regardless of whether the modules 52, 54 and 56 are provided separately or as an attached structure, the entire play structure 50 may be conveniently folded and collapsed, thereby making it convenient to move around the home, and requiring little storage space. If the modules 52, 54 and 56 are provided separately, the child further derives an additional variety of play since he or she can create play structures of different shapes. Additionally, the child may derive amusement by attempting to align the openings 90 and 92 in the interfacing side panels so that he or she can crawl from one module into another.

Although the play structure 50 is shown as having three modules 52, 54 and 56, each being of the same size and shape, it will be appreciated that the present invention encompasses within its scope play structures having any number of modules, each having any number of different sizes and shapes and being made from side panels having any number of different sizes and shapes.

Figure 6:
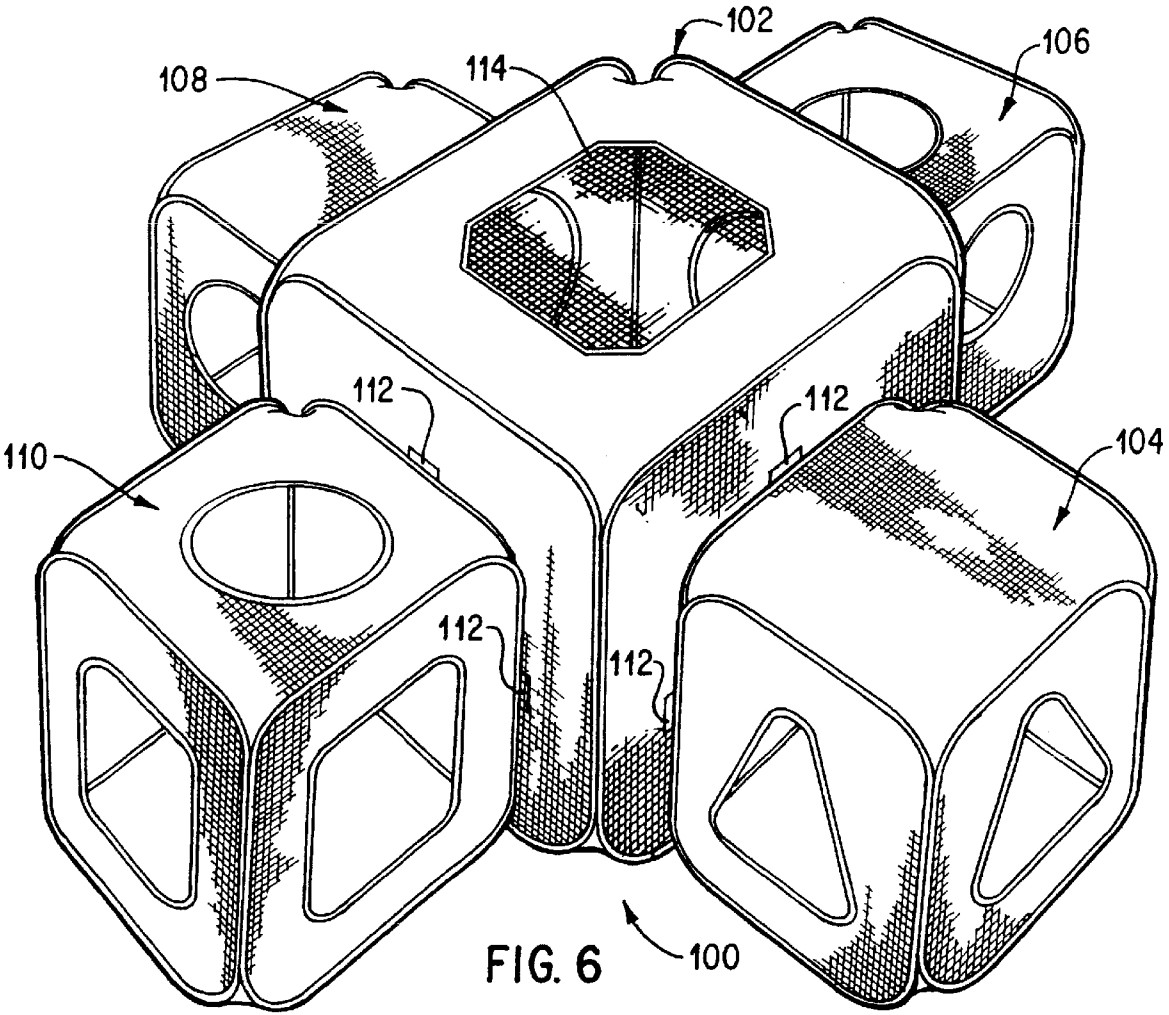
FIG. 6 is a perspective view of a collapsible play structure according to a third preferred embodiment of the present invention comprising four modules connected to the different side panels of one large module.

An example is illustrated in the third preferred embodiment of FIG. 6. The play structure 100 comprises a large module 102, and four identical but smaller modules 104, 106, 108 and 110, each connected to one of the four side panels of the large module 102 by a conventional attachment method, for example, velcro 112. A mesh 114 may be provided to cover an opening in the large module 102. The openings in the modules 102, 104, 106, 108 and 110 may be provided in varying shapes and sizes. Although the play structure 100 is shown as having four identical modules 104, 106, 108 and 110, these four modules may be provided in different shapes and sizes.

The separate modules according to the present invention may be provided or purchased on an individual basis, in different shapes and sizes, so that a child may be able to create a play structure of a desired shape and size. Alternatively, a specific number of differently shaped and sized modules may be packaged and sold together. In either case, the child will have the opportunity to create an endless variety of play structures at his or her disposal, thereby enhancing the amusement value of the modules, and stimulating creativity in the child by challenging the child to create as many different play structures as possible.

Figure 7:
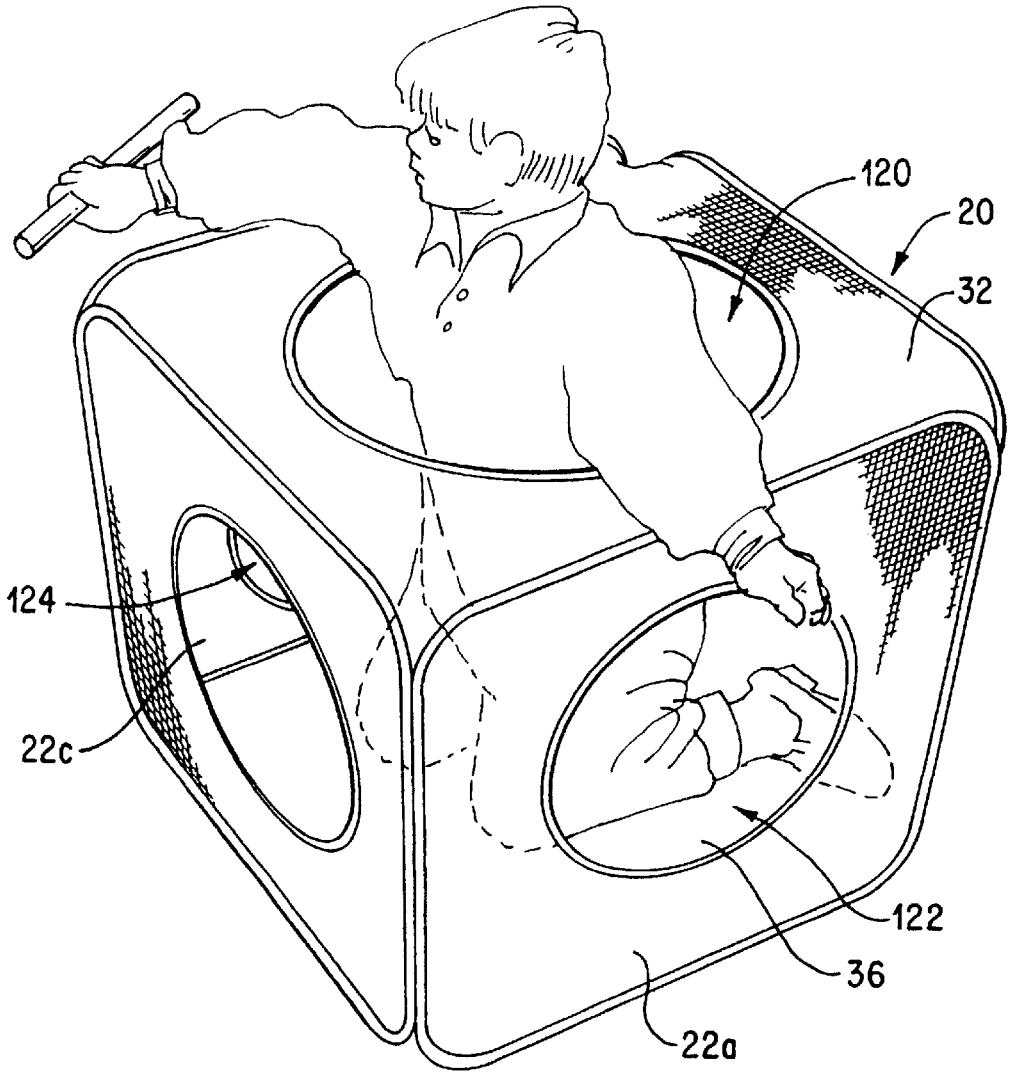
FIG. 7 is a perspective view of the collapsible play structure of FIG. 1 which may be sized to allow a child to wear the structure as part of a costume.

FIG. 7 illustrates an additional application for the module 20. The module 20 may be sized such that it may be fitted around the body of a child, to act as part of a costume. The module 20 may then be able to support other bulky costumes, and would be especially useful for occasions such as halloween. For example, the child's head and arms could extend through opening 120 in the upper panel 32 and his legs could extend through an opening (not shown) in the lower panel 36. Alternatively, the module 20 could be sized small enough so that the child's arms could extend through the openings 122 and 124 in the side panels 22*a* and 22*c*, respectively. Further, the lower panel 36 could be omitted if desired.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure, comprising:

at least three foldable frame members, each having a folded and an unfolded orientation, each frame member arranged between and connected to a pair of said adjacent frame members;

wherein each frame member forms a flat and continuous loop in its unfolded orientation;

wherein the frame members, when fully deployed, form a ring of flat loops that enclose an interior space;

and wherein each frame member is twisted and folded to form a plurality of concentric rings in the folded orientation.

2. The structure of claim 1, further including:

a fabric material covering portions of at least two of the frame members to define a flat surface when its respective frame member in its unfolded orientation.

3. The structure of claim 1, further including:

a fabric material covering portions of each frame member to form a panel for each frame member when the frame member is in the unfolded orientation, with an opening provided in the fabric material of at least one of the panels.

4. The structure of claim 1, further including a frame retaining sleeve that retains each of the frame members.

* * * * *